US008596982B2

(12) United States Patent
Nishioka et al.

(10) Patent No.: US 8,596,982 B2
(45) Date of Patent: Dec. 3, 2013

(54) TURBINE ROTOR

(75) Inventors: Eiji Nishioka, Hitachinaka (JP); Masahiko Arai, Hitachinaka (JP); Hiroyuki Doi, Tokai (JP)

(73) Assignee: Hitachi, Ltd., Tokyo (JP)

( * ) Notice: Subject to any disclaimer, the term of this patent is extended or adjusted under 35 U.S.C. 154(b) by 625 days.

(21) Appl. No.: 12/821,433

(22) Filed: Jun. 23, 2010

(65) Prior Publication Data

US 2010/0329849 A1 Dec. 30, 2010

(30) Foreign Application Priority Data

Jun. 30, 2009 (JP) ..... 2009-154513

(51) Int. Cl.
*F01D 5/08* (2006.01)

(52) U.S. Cl.
USPC ..... 416/213 R; 415/216.1

(58) Field of Classification Search
USPC ..... 29/525.14, 889.2, 889.21, 889.22; 415/199.5, 200, 216.1; 416/213 R, 416/244 A
See application file for complete search history.

(56) References Cited

U.S. PATENT DOCUMENTS

| | | | | |
|---|---|---|---|---|
| 920,789 | A * | 5/1909 | Thomson | 415/134 |
| 4,021,138 | A * | 5/1977 | Scalzo et al. | 416/95 |
| 4,047,837 | A | 9/1977 | Hueber et al. | |
| 4,830,575 | A * | 5/1989 | Bandukwalla | 416/95 |
| 4,958,431 | A * | 9/1990 | Clark et al. | 29/889.1 |
| 6,648,600 | B2 * | 11/2003 | Takahashi et al. | 416/97 R |
| 6,746,204 | B2 * | 6/2004 | Takahashi et al. | 415/115 |
| 6,969,238 | B2 * | 11/2005 | Groh et al. | 416/213 R |
| 8,083,872 | B2 * | 12/2011 | Mitchell et al. | 148/559 |
| 8,323,424 | B2 * | 12/2012 | Mitchell et al. | 148/426 |
| 2008/0250790 | A1 | 10/2008 | Imano et al. | |
| 2010/0028155 | A1 * | 2/2010 | Nishioka et al. | 416/223 A |
| 2010/0329849 | A1 * | 12/2010 | Nishioka et al. | 415/115 |
| 2012/0301309 | A1 * | 11/2012 | Nishioka et al. | 416/223 R |

FOREIGN PATENT DOCUMENTS

| | | |
|---|---|---|
| CN | 1495339 | 5/2004 |
| EP | 0 806 544 | 11/1997 |
| EP | 0 921 273 | 6/1999 |
| GB | 580036 | 8/1946 |
| GB | 582825 | 11/1946 |
| GB | 665956 | 2/1952 |
| GB | 806810 | 12/1958 |

(Continued)

OTHER PUBLICATIONS

Chinese office action dated Jan. 25, 2013 with Japanese translation.

(Continued)

*Primary Examiner* — Edward Look
*Assistant Examiner* — Christopher R Legendre
(74) *Attorney, Agent, or Firm* — Antonelli, Terry, Stout & Kraus, LLP.

(57) ABSTRACT

A turbine rotor which is easy to manufacture and has a high tolerable temperature is provided. A highly efficient steam turbine power plant is also provided. The turbine rotor is configured from a rotor shaft, an inner rotor disc constructed integrally with the rotor shaft, and an outer rotor disc which is welded to the inner rotor disc via a weld metal part and has a structure for fixing a turbine blade. The outer rotor disc preferably has a cooling hole which extends in an axial direction to penetrate the outer rotor disc over the thickness of the outer rotor disc.

18 Claims, 11 Drawing Sheets

(56) References Cited

FOREIGN PATENT DOCUMENTS

| | | | | |
|---|---|---|---|---|
| JP | 60159304 A | * | 8/1985 | ..... F01D 5/08 |
| JP | 7-42508 | | 2/1995 | |
| JP | 7-145707 | | 6/1995 | |
| JP | 8-177526 | | 7/1996 | |
| JP | 2002-508044 | | 3/2002 | |
| JP | 2003-269106 | | 9/2003 | |
| JP | 2004-169562 | | 6/2004 | |
| JP | 2004-239262 | | 8/2004 | |
| JP | 2009-97052 | | 5/2009 | |
| JP | 2010-31812 | | 2/2010 | |

OTHER PUBLICATIONS

Chinese Office Action of Appln. No. 201010220695.6 dated Jun. 5, 2013.

* cited by examiner

ELLIPSE EXTENDING IN CIRCUMFERENTIAL DIRECTION

ELLIPSE EXTENDING IN RADIAL DIRECTION

AGGREGATE OF CIRCLES WITH RADIUSES VARYING IN RADIAL DIRECTION

AGGREGATE OF CIRCLES WITH RADIUSES VARYING PERIODICALLY

PERIOD : ARRANGEMENT IN ONE STRAIGHT LINE IN RADIAL DIRECTION

TURBINE ROTOR

BACKGROUND OF THE INVENTION

1. Field of the Invention

The present invention relates to a turbine rotor.

2. Description of Related Art

Energy conservation and environmental conservation, and in particular reduction in $CO_2$ has begun to attract growing interest, and it is desired in the field of a steam turbine power generation plant to increase the capacity and enhance the thermal efficiency. Enhancement in thermal efficiency is achieved by increasing the temperature and pressure of steam, and further increase in temperature is planed in future. The first stage blade of a high pressure turbine is the first element to be exposed to steam among rotating elements, and it is necessary to secure durability to high-temperature and high-pressure steam, and in particular to secure strength reliability, among others.

In a conventional material including iron as a main component, if the main steam temperature exceeds 650° C., the high-temperature strength, in particular creep strength, abruptly reduces. The countermeasures against high-temperature steam have been taken by cooling of a rotating body and the like so far. JP-A-2004-239262 and JP-A-2002-508044 each describe a method of cooling a rotor by providing a cooling hole extending from the inside of a shaft of a rotor shaft to an intermediate portion between discs, and by passing a cooling medium in the cooling hole. JP-A-7-145707 and JP-A-7-42508 each describe a cooling method in which a cooling hole is provided in a bottom of a rotor disc. JP-A-2004-169652 describes production of a rotor from an Ni-base super alloy with high heat resistance.

BRIEF SUMMARY OF THE INVENTION

In order to cool the inside of a rotor shaft in the axial direction, a cooling hole which penetrates through the rotor shaft is needed. Since the axial length of the rotor shaft measures several meters, much effort and cost are required for providing the cooling hole. Further, when the cooling hole is provided in the inside and the bottom of the rotor disc, the temperature of the bottom portion of the rotor disc drops, but the temperature of the central portion and the outer circumferential portion of the rotor disc hardly drops.

Further, although the tolerable temperature of a Ni-base alloy is high, it is the material from which production of large steel ingots is difficult. Therefore, it is difficult to produce a turbine rotor entire from the Ni-base alloy. Further, the Ni-base alloy has the problem that the cost is high.

Thus, an object of the invention of the present application is to provide a turbine rotor with a high tolerable temperature and easy to produce.

The features of the present invention that solves the above described problem lie in a turbine rotor constituted by a rotor shaft, an inner rotor disc integrated with the rotor shaft, and an outer rotor disc which is welded to the inner rotor disc via a weld metal part and has a structure for fixing a turbine blade thereon.

When the outer rotor disc is made from an Ni-base super alloy material, the inner rotor disc is desirably made from a high chrome steel material such as 12Cr steel, or a low alloy steel material such as CrMoV steel. Alternatively, when the outer rotor disc is made from a high chrome steel material including 12Cr steel, the inner rotor disc is desirably made from low alloy steel including CrMoV steel.

Further, the outer rotor disc preferably has a cooling hole which extends in the axial direction to penetrate the outer rotor disc over the thickness of the outer rotor disc. The sectional shape of the cooling hole provided in the outer rotor disc is desirably circular or elliptical. Further, the size of the cooling hole on an inner circumferential side is desirably smaller than that on an outer circumferential side. Further, the cooling holes are desirably distributed more densely on the outer side as compared with those on the inner side. Further, the cooling holes are desired not to be arranged in a straight line extending in the radial direction with respect to another cooling hole.

As described above, the turbine rotor with a high tolerable temperature and capable of being easily manufactured can be provided. Further, the turbine rotor can cope with enhancement in steam temperature, and therefore contributes to enhancement in efficiency of a steam turbine power plant.

Other objects, features and advantages of the invention will become apparent from the following description of the embodiments of the invention taken in conjunction with the accompanying drawings.

DETAILED DESCRIPTION OF THE INVENTION

A rotor disc is divided into an outer rotor disc and an inner rotor disc, and the outer rotor disc and the inner rotor disc are integrated by welding via a weld metal part. Through-holes extending in an axial direction are provided in the outer rotor disc. As a result, the through-holes become cooling holes. As a result that the through-holes are provided outside the weld metal part, the periphery of the through-hole portions is cooled, and even when the outer circumferential side of the outer rotor disc is at a high temperature, the temperatures of the weld metal part, the inner rotor disc and a rotor shaft are not increased. Accordingly, a material with lower durability against a high temperature can be applied to the inner rotor disc and the rotor shaft as compared to the outer rotor disc which is directly in contact with high-temperature steam.

For example, in the case of using an outer rotor disc of an Ni-base alloy, Fe-base heat resistant steel (a high chrome steel material such as 12Cr steel, a low alloy steel material such as CrMoV steel) can be used for the inner rotor disc and the rotor shaft. By this structure, a Ni-base alloy from which production of a large steel ingot is difficult can be easily applied to a turbine rotor. Further, as another example, the outer rotor disc may be made from a high chrome steel material including 12Cr steel, and the inner rotor disc may be made from a low alloy steel material including CrMoV steel.

As a result, it becomes possible to cope with high-temperature steam, and the efficiency of the steam turbine plant can be enhanced. Further, as compared with the case of providing a cooling structure in the rotor shaft, working becomes easy, and time, efforts and cost are not so required. Further, when the steam temperature of the steam turbine plant is considered, the use amount of the high-level material with high heat resistance can be reduced. Therefore, the turbine rotor can be produced at low cost while being equipped with a high tolerable temperature, and the cost of the plant can be reduced. Further, the turbine rotor can be used at a high temperature, and therefore, contributes to enhancement in efficiency of the plant.

At least, the above described structure needs to be adopted in a rotor disc at the highest temperature side (steam inlet side) of the turbine rotor. At the rear stage side, the rotor disc with a sufficiently low steam temperature can be made integral without being divided into the inner side and the outer side, and an expensive material with high heat resistance can be omitted.

Hereinafter, the best mode for carrying out a turbine rotor of the present invention will be described in detail according to concrete embodiments.

Embodiment 1

A first embodiment will be described by using FIGS. 1 to 5.

Figure 1:
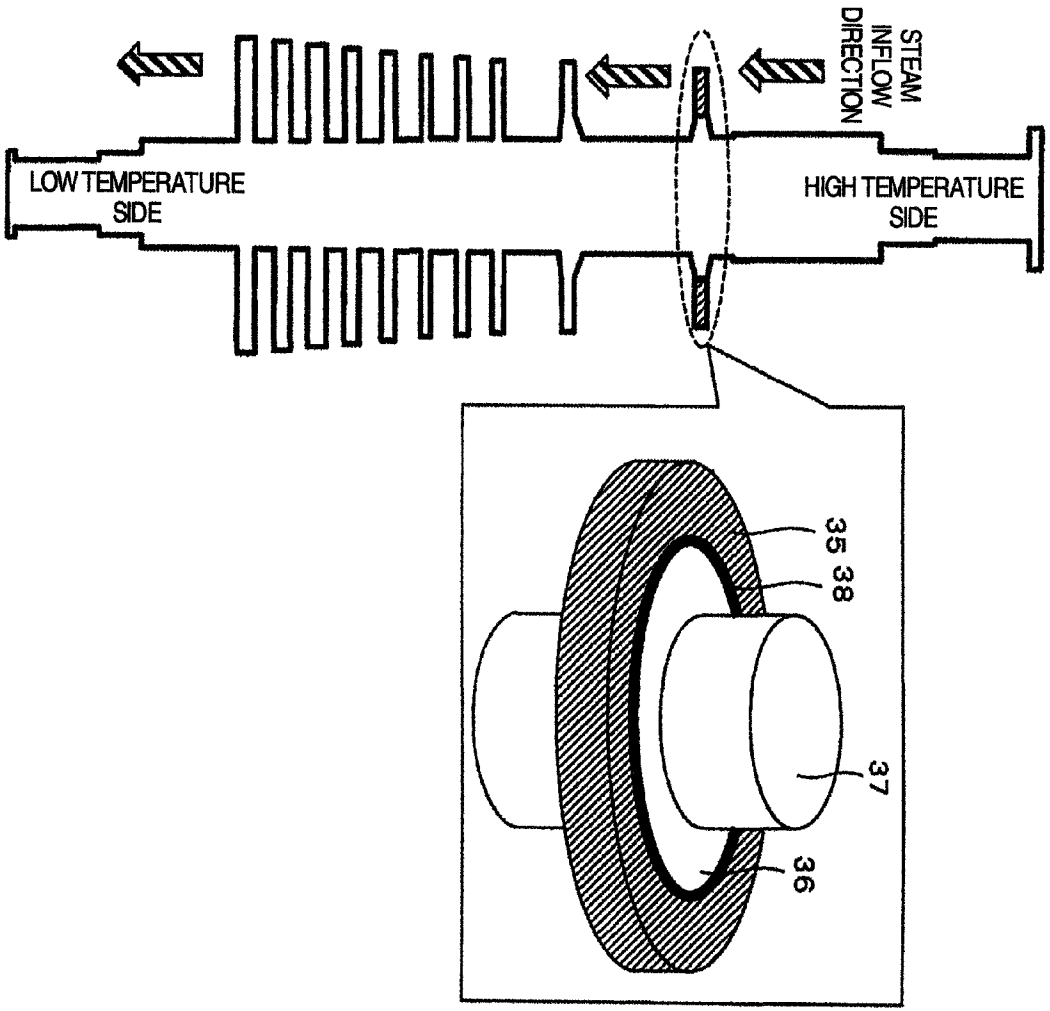
FIG. 1 is a sectional view of a turbine rotor according to embodiment 1.

FIG. 1 is a sectional view of a turbine rotor for high pressure steam having a rotor disc. The turbine rotor includes an outer rotor disc 35, an inner rotor disc 36, and a rotor shaft 37, and the outer rotor disc 35 and the inner rotor disc 36 are fastened by welding via a weld metal 38, and are integrated. A structure such as a fixing groove for fastening a rotor blade is provided on an outer circumferential side of the rotor disc.

In the present embodiment, because the outer rotor disc 35 requires high temperature strength, an Ni-base alloy material is used therefor. The inner rotor disc 36 does not require such high temperature strength as the outer side, and therefore, less expensive 12Cr steel (high chrome steel) is used therefor. In the present embodiment, the inner rotor disc is formed by 12Cr steel integrally with the rotor shaft 37. The weld metal 38 can be selected in accordance with the temperature to which the weld metal 38 is exposed. When the exposure temperature is close to that of the outer rotor disc 35, a weld material of an Ni-base alloy is used, whereas a weld material of high chrome steel is used when the exposure temperature is close to that of the inner rotor disc 36.

Figure 2:
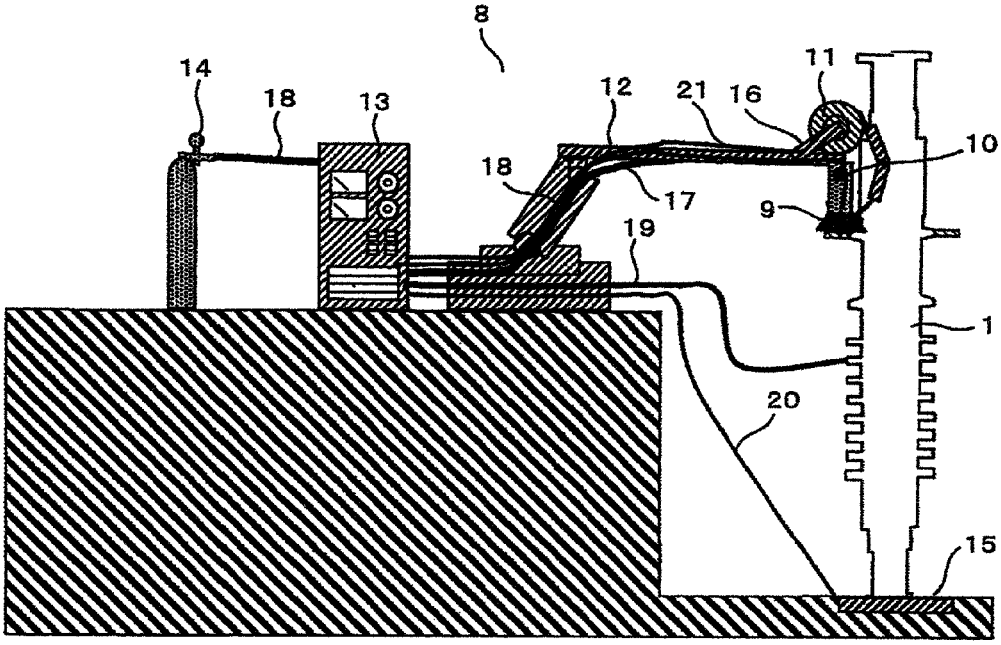
FIG. 2 is a schematic view of a welding machine.

FIG. 2 shows an example of a welding machine for welding the turbine rotor. FIG. 2 is a schematic view of the welding machine utilizing a tungsten/inert gas (TIG) welding method. A welding machine 8 includes a torch 10 to which an electrode 9 is attached, a weld wire 11 for forming a weld 6, an arm 12 which supports and fixes the torch 10 and the weld wire 11, a weld power 13 which supplies current of a predetermined value to the electrode 9, a gas bombe 14 which supplies an inert gas to be injected from the periphery of the electrode 9 to suppress oxidation of the weld 6, a positioner 15 for rotating a turbine rotor 1 while supporting the turbine rotor 1, and a wire feeder 16 which feeds the weld wire 11 to the weld 6. A power cable 17 from the weld power 13 is attached to the electrode 9, and the current is supplied from the weld power 13. A gas hose 18 is attached to the torch 10 to receive supply of the inert gas from the gas bombe 14. A power cable 19 is attached to the turbine rotor 1 to generate electric arc between the electrode 9 and the turbine rotor 1. A signal cable 20 for the positioner is attached to the positioner 15 so as to receive a control signal from the weld power 13 to control the rotational speed and the rotational direction of the positioner 15. The wire feeder 16 is configured so as to receive a control signal from a signal cable 21 for the wire feeder to control the feeding speed of the weld wire 11.

Other than the tungsten/inert gas (TIG) welding machine shown in FIG. 2, a welding machine utilizing a submerge arc (SAW) welding method, a coating arc welding method, a metal/inert gas (MIG) welding method or a welding method of the combination of these methods can be applied to the present embodiment.

Further, in FIG. 2, welding is performed downward while arranging the rotor vertically, but the welding may be performed laterally while arranging the rotor horizontally.

Figure 3:
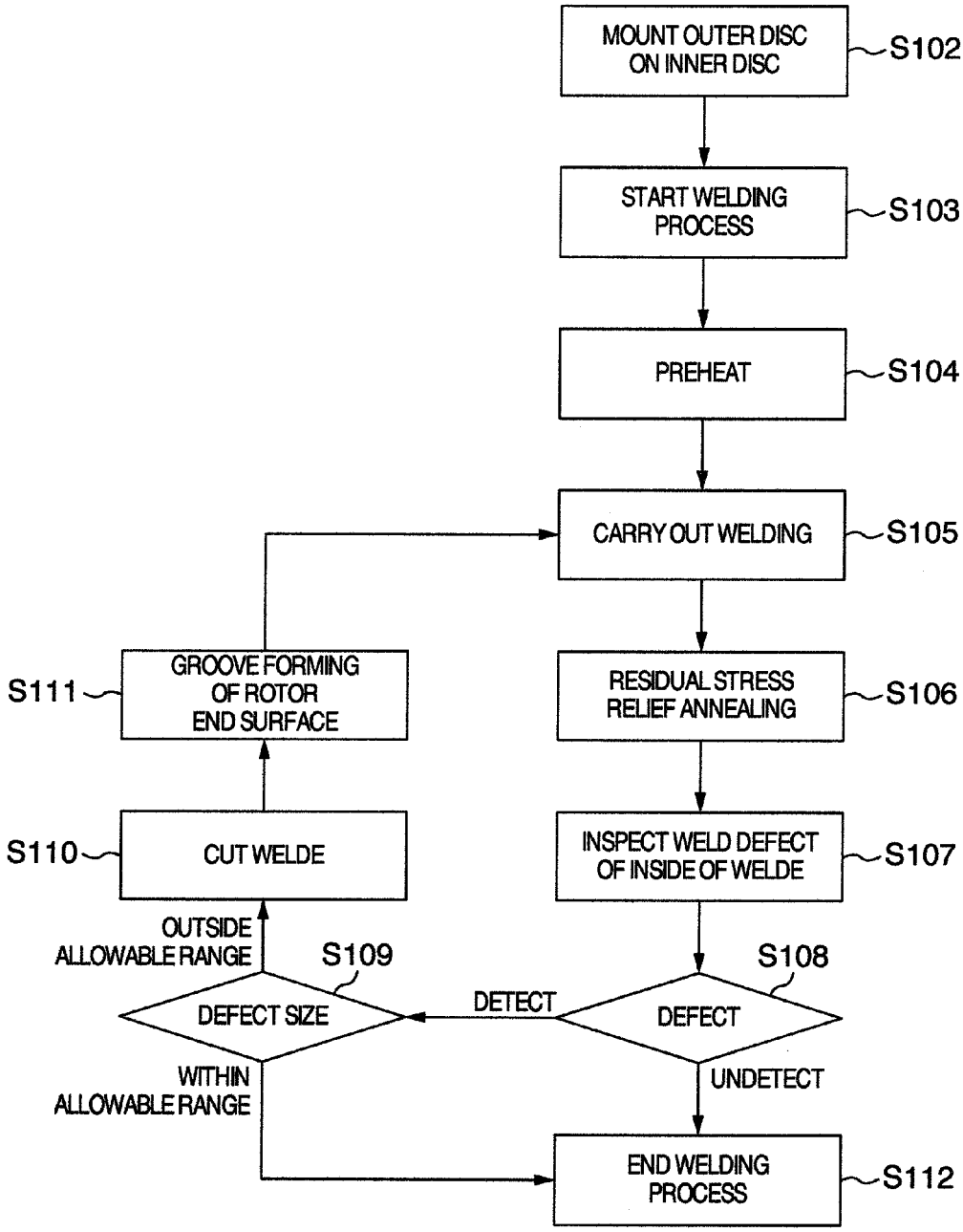
FIG. 3 is a flow chart showing a turbine rotor welding process according to embodiment 1.

FIG. 3 shows one example of a process flow of welding the outer rotor disc 35 to the inner rotor disc 36. First, in step 102, the outer rotor disc 35 is mounted onto the inner rotor disc 36. Thereafter, when instructions to start the weld process are issued in step 103, the rotor is preheated to alleviate the thermal stress at the time of the welding, in step 104. In step 105, the welding is performed by the welding machine shown in FIG. 2. In step 106, stress relief annealing is performed to uniformalize the heat entering the weld 6 in final weld. In step 107, weld defect inspection of the weld 6 is performed. When a defect is found in step 108, and the defect size is not allowable in light of mechanical strength in step 109, the weld 6 is cut in step 110, and a rotor end surface is grooved in step 111. When a defect is not found in step 108, or the defect size can be confirmed to be allowable in step 109, the flow goes to step 112 and the joining process is finished.

Figure 4:
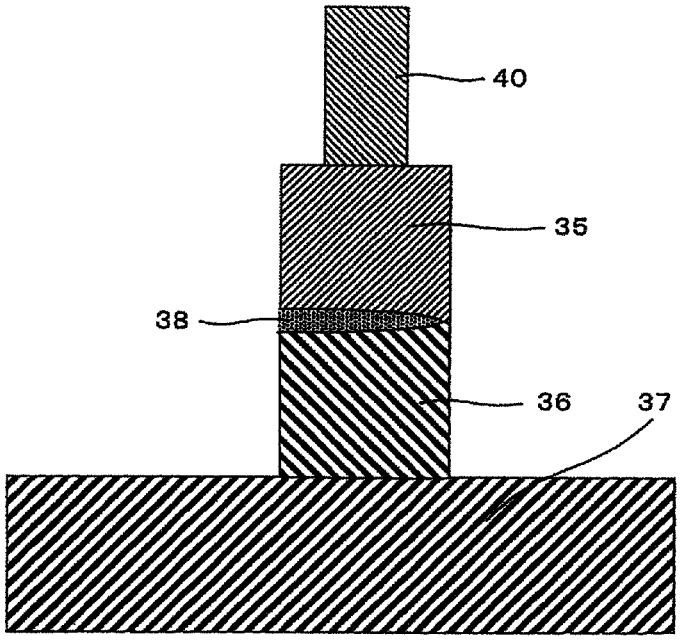
FIG. 4 is a schematic view of a vicinity of a weld according to embodiment 1.

FIG. 4 shows a vertical section in the vicinity of the weld after the outer rotor disc 35 is welded to the inner rotor disc 36. In (1) of FIG. 5, a schematic view of a cross section is shown. A turbine blade 40 is attached to the outer side of the outer rotor disc 35. Also in this example, the inner rotor disc 36 is formed integrally with the rotor shaft 37. The outer rotor disc 35 and the inner rotor disc 36 are fastened by welding with the weld metal 38 which is melted therebetween.

Figure 5:
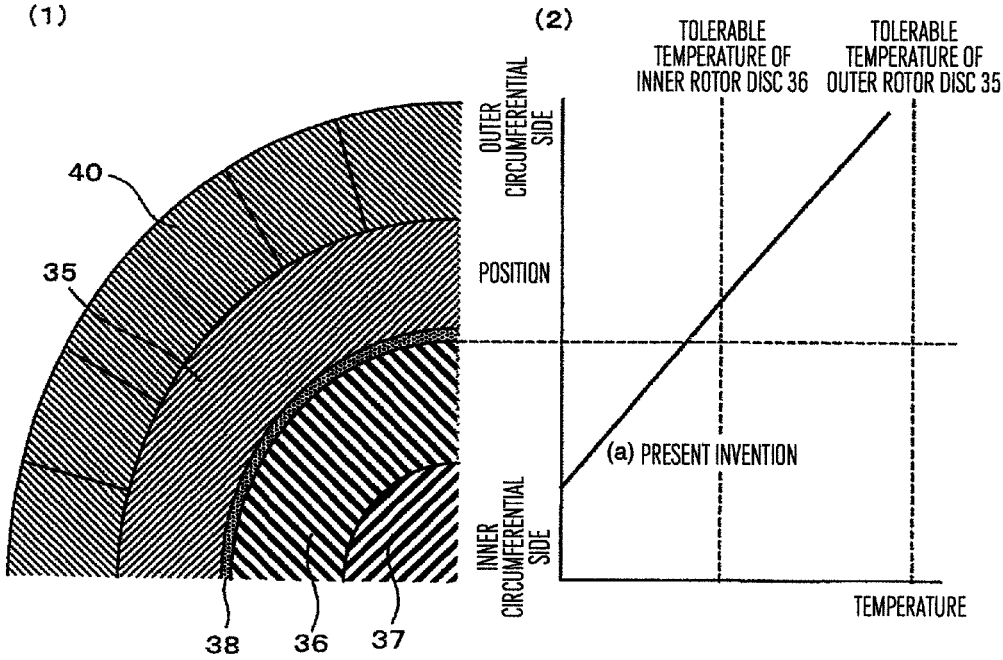
FIG. 5 is a cross-sectional schematic view of a rotor disc 36 according to embodiment 1.

Further, in (2) of FIG. 5, a schematic diagram of a temperature distribution of the rotor disc is shown. The axis of abscissa represents the temperature, and the tolerable temperatures of the inner rotor disc 36 and the outer rotor disc 35 are additionally described by the broken lines. The axis of ordinate represents the position of the rotor disc, and the broken line represents the position of the weld metal 38. The turbine blade 40 is exposed to steam, and therefore, raised to a high temperature. The heat advances toward the bottom of the rotor disc and is propagated while the temperature gradually drops. Subsequently, a location exists, where the temperature of the rotor disc is below the tolerable temperature of the high chrome steel. This region can be replaced with the inner rotor disc 36 produced from high chrome steel. Thereby, the inner rotor disc 36, which is produced from high chrome steel from which a less expensive large steel ingot is easily produced, can properly continue operation.

Thus, according to the present embodiment, while the use amount of an Ni-base alloy with high heat resistance is reduced, adaptation to high temperature of steam can be realized, and therefore, reduction in cost and enhancement in efficiency of the plant are made compatible. In the present embodiment, the two rotor discs on the inner side and the outer side are used, but the rotor disc may be divided into three or more parts including inner, outer and middle parts.

Embodiment 2

Figure 6:
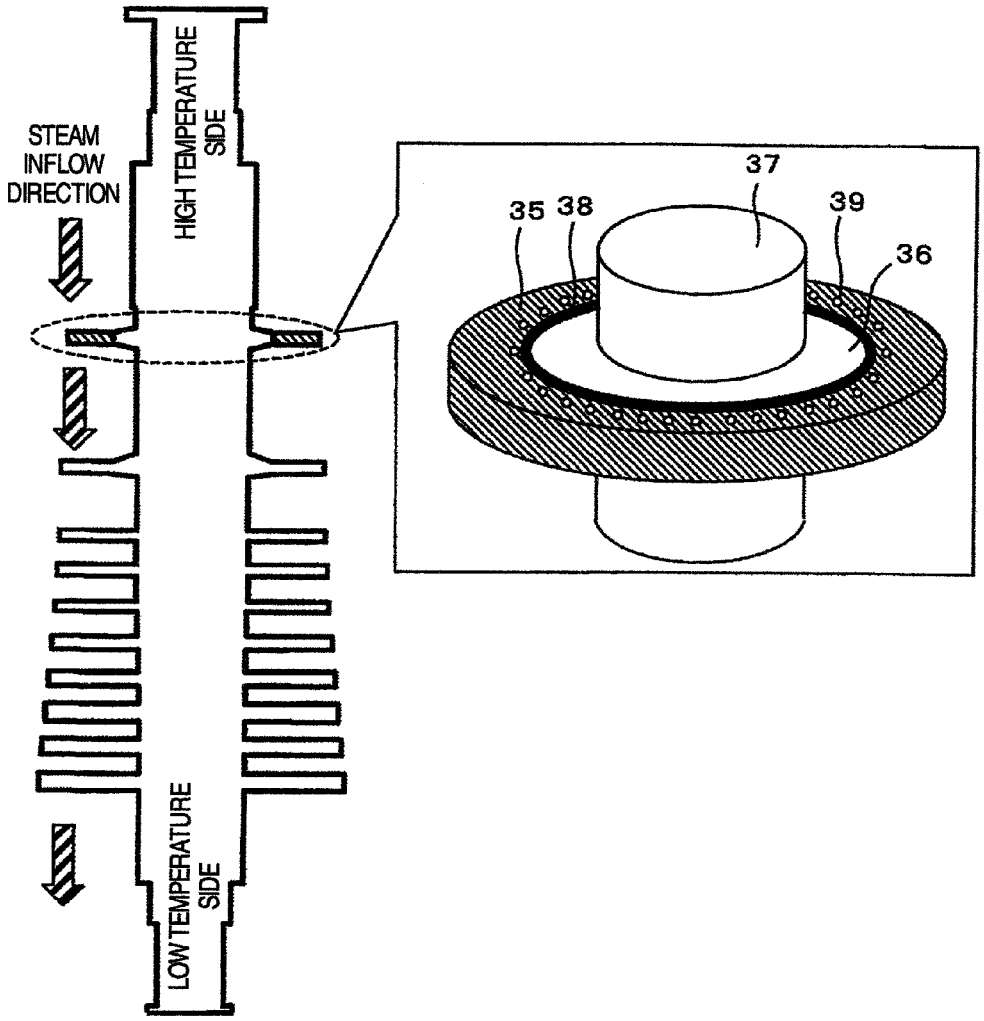
FIG. 6 is a sectional view of a turbine rotor according to embodiment 2.

By using FIGS. 6 to 11, a second embodiment will be described. FIG. 6 is a sectional view of a turbine rotor for high-pressure steam according to the present embodiment. In the present embodiment, as shown in FIG. 6, the outer rotor disc 35 is provided with cooling holes 39 which penetrate the disc in the axial direction of the rotor shaft. The other parts are the same as those in embodiment 1. Therefore, the detailed description will be omitted, and only the difference will be described.

Figure 7:
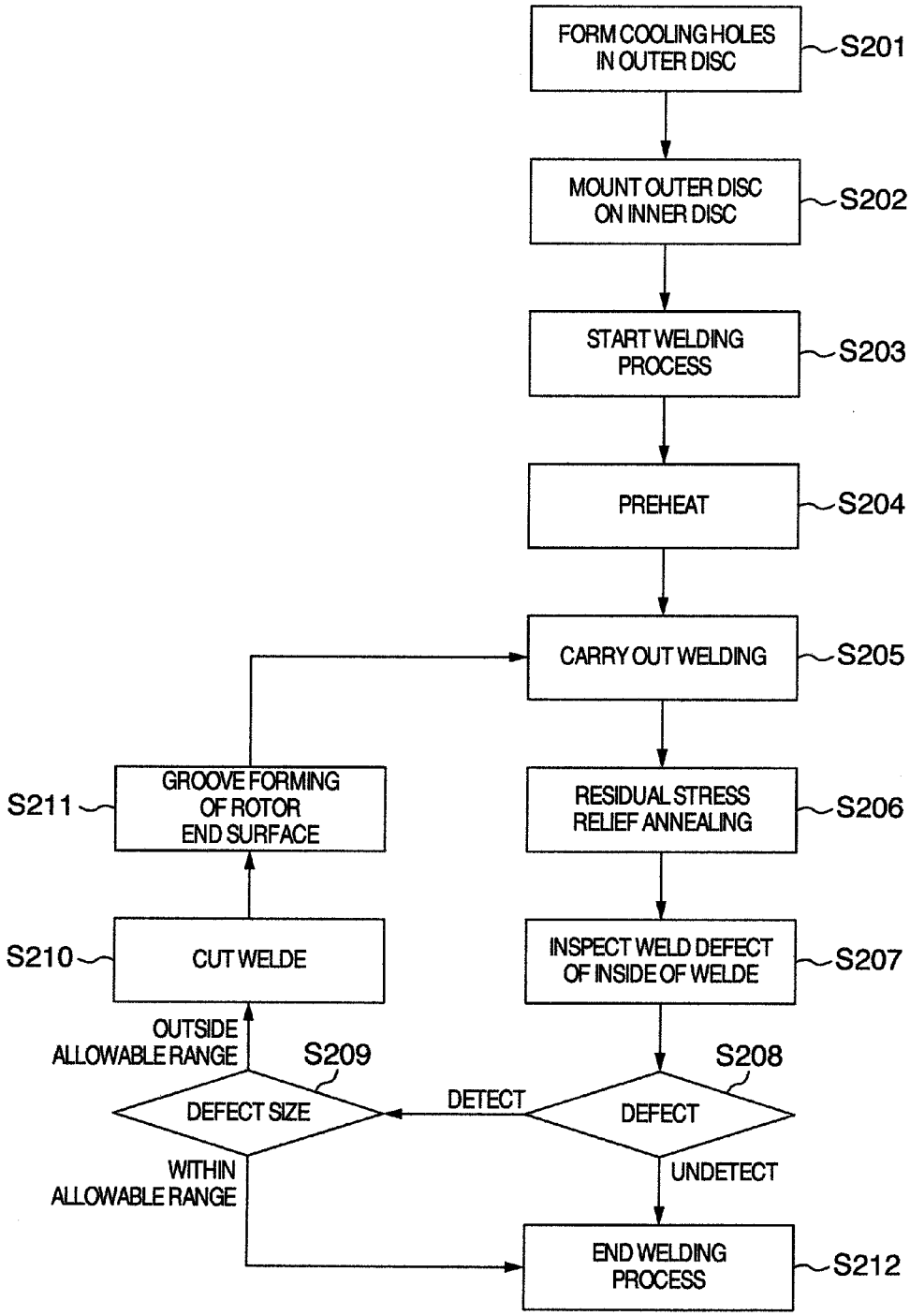
FIG. 7 is a flow chart showing a turbine rotor welding process according to embodiment 2.

FIG. 7 shows one example of a process flow of welding the outer rotor disc 35 to the inner rotor disc 36 in the turbine rotor according to the present embodiment. First, in step 201, processing for introducing the cooling holes 39 into the outer disc 35 is performed. Next, in step 202, the outer rotor disc 35 is mounted on the rotor disc 36. Thereafter, when the instructions to start the welding process is issued in step 203, the rotor is preheated in order to alleviate the thermal stress at the time of welding in step 204. Subsequently, in step 205, the welding is performed by the welding machine shown in FIG. 2. In step 206, stress relief annealing is performed to uniformalize the heat which enters the weld 6 in the present weld. In step 207, weld defect inspection of the weld 6 is performed. When a defect is found in step 208, and the defect size thereof is not allowable in light of mechanical strength in step 209, the weld 6 is cut in step 210, and in step 211, the rotor end surface is grooved. When a defect is not found in step 208, or the defect size can be confirmed to be allowable in step 209, the flow goes to step 212 to end the joining process.

Figure 8:
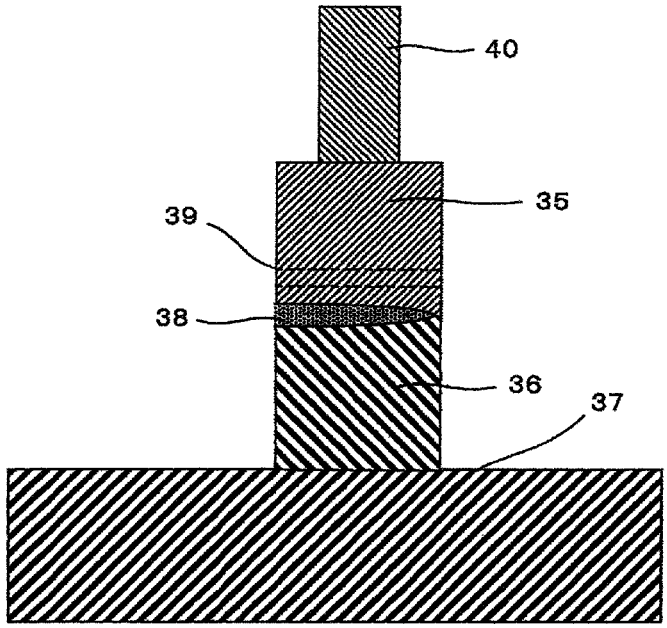
FIG. 8 is a schematic view of a vicinity of a weld according to embodiment 2.

FIG. 8 shows a vertical section of the vicinity of the weld after welding of the rotor disc 36 to which the outer rotor disc 35 is welded. In (1) of FIG. 9, a schematic view of a cross section is shown. The turbine blade 40 is attached to the outer circumferential side of the outer rotor disc 35. The inner rotor disc 36 is formed integrally with the rotor shaft 37. The outer rotor disc 35 and the inner rotor disc 36 are welded with the weld metal 38 by melting it therebetween, and integrated. The cooling holes 39 are provided in the outer rotor disc 35, and penetrate the outer disc 35 in the axial direction.

Figure 9:
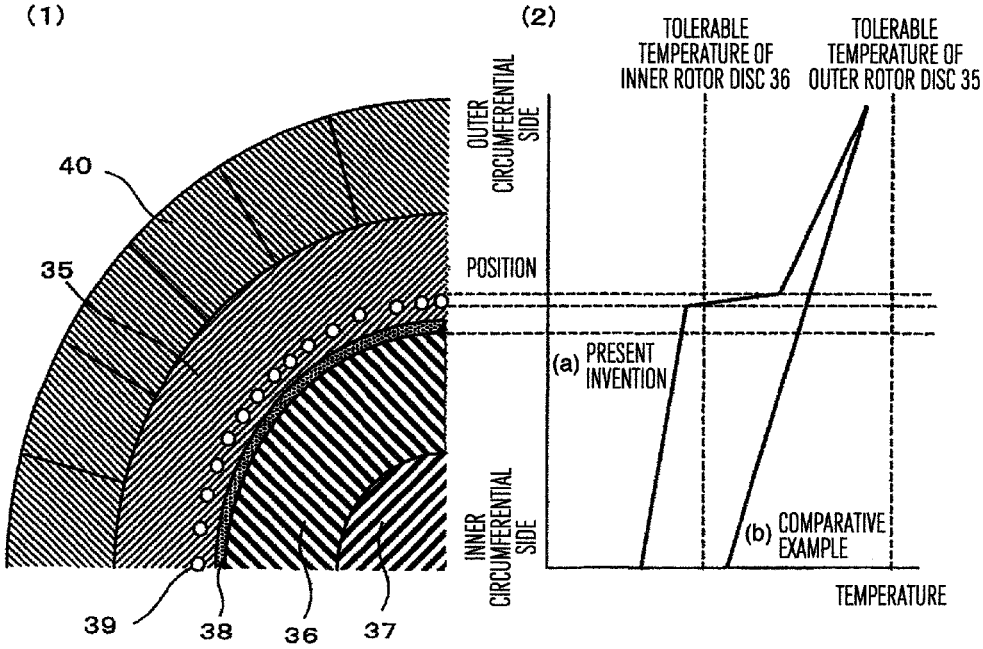
FIG. 9 is a cross-sectional schematic view of a rotor disc 36 according to embodiment 2.

In (2) of FIG. 9, a schematic diagram of the temperature distribution of the rotor disc is shown. The axis of abscissa represents the temperature, and the tolerable temperatures of the inner rotor disc 36 and the outer rotor disc 35 are additionally described by the broken lines. The axis of ordinate represents the position of the rotor disc, and the outer circumference and the inner circumference of the cooling hole 39, and the weld metal 38 are respectively shown by the broken lines in sequence from the upper side. (a) in (2) of FIG. 9 represents the temperature distribution of the rotor disc of the present embodiment, and (b) shows an comparative example. In the present embodiment of (a), the turbine blade 40 is exposed to steam, and therefore, raised to a high temperature. The heat advances toward the bottom of the rotor disc, and is propagated while its temperature is dropping. Subsequently, the heat is cooled in the cooling holes 39, and the temperature gradient thereof becomes higher than that in the outer rotor disc 35. Here, the temperature at the inner circumference of the cooling hole 39 is below the tolerable temperature of the inner rotor disc 36. Thereby, the inner rotor disc 36, which is produced of a material from which production of less expensive large steel ingot is easy, can properly continue operation. Meanwhile, the comparative example of (b) does not have the cooling holes 39 as in (a), and therefore, the temperature gradient remains gradual. The temperature of the bottom portion of the rotor disc exceeds the tolerable temperature of the material which is used for the material of the inner rotor disc 36 and makes production of a less expensive large steel ingot easy. In this case, it is necessary to increase the range of the outer rotor disc with high resistance against high temperature, to produce the turbine rotor by using a material from which production of an expensive large steel ingot is difficult, or to provide another cooling means.

Figure 10:
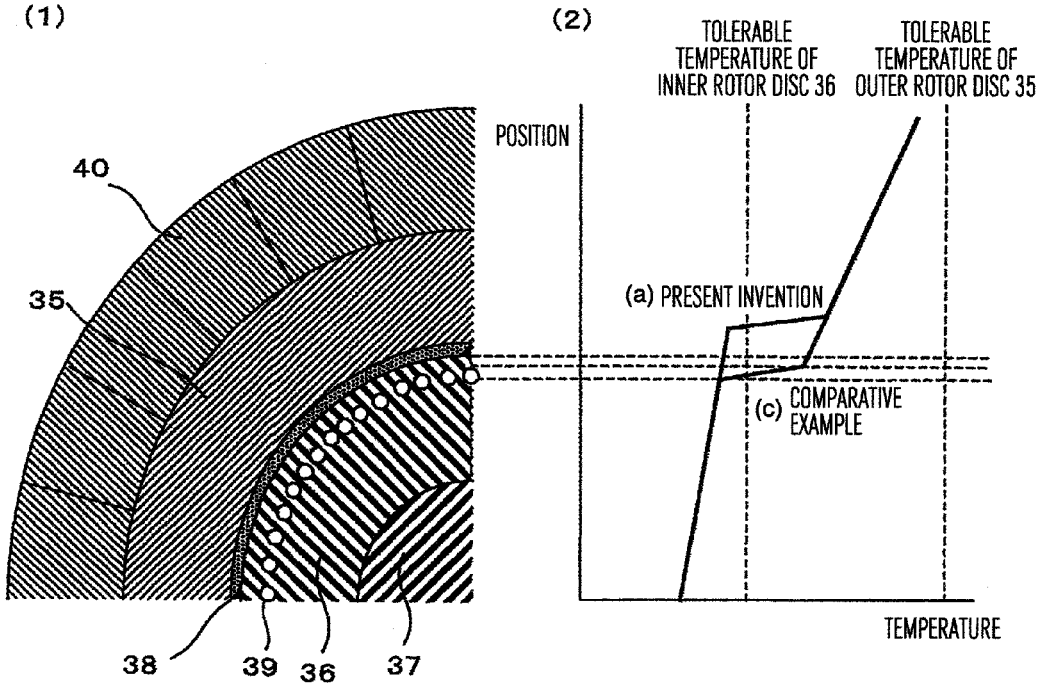
FIG. 10 is a cross-sectional schematic view of a rotor disc 36 of a comparative example.

In (1) of FIG. 10, a cross-sectional schematic view of a rotor disc of a comparative example is shown. The comparative example differs from the embodiment of the present invention in that the cooling holes 39 of the comparative example are located in the inner rotor disc 36. Further, in (2) of FIG. 10, a schematic diagram of the temperature distribution of the rotor disc is shown. (a) in (2) of FIG. 9 represents the present embodiment, and (c) represents one example of the comparative example. In the case of the comparative example of (c), heat is rapidly cooled in the cooling holes 39 as in the present embodiment of (a). However, before the heat is cooled, the temperature of the inner rotor disc 36 is likely to exceed the tolerable temperature of the material of the inner rotor disc 36. When the heat exceeds the tolerable temperature, the inner rotor disc 36 cannot properly continue operation, and therefore, the cooling holes 39 are preferably provided in the outer rotor disc 35.

In the present embodiment, the cooling holes are concentrically provided about the axis of the rotor shaft, but the cooling holes do not have to be provided concentrically. The same thing applies to the embodiments which will be described later. However, the turbine rotor is a body of rotation, and therefore, is desirably made centrosymmetrical.

Thus, according to the present embodiment, the turbine rotor can cope with a higher temperature of steam, and therefore, the turbine rotor can contribute to enhancement in efficiency of the plant. Further, the use amount of the high-level material with high heat resistance can be reduced, and cost of the plant can be reduced.

Embodiment 3

Concerning a third embodiment, the shape and arrangement of openings of cooling holes will be described by using FIGS. 11 and 12. In embodiment 2, described is the example showing that the through-holes which are arranged in a row in the circumferential direction and have a circular section are provided. The present embodiment differs from embodiment 2 in respect only of the shape of the cooling hole 39, and is the same as the embodiment 2 in the other respects. Therefore, the description thereof will be partially omitted.

Figure 11:
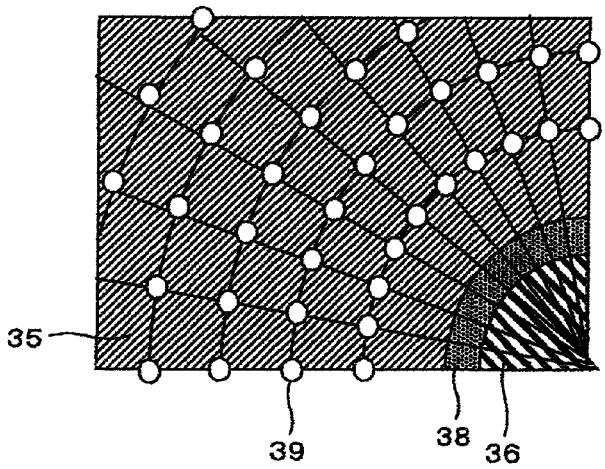
FIG. 11 is a schematic view showing cooling holes according to embodiment 2.
Figure 12A:
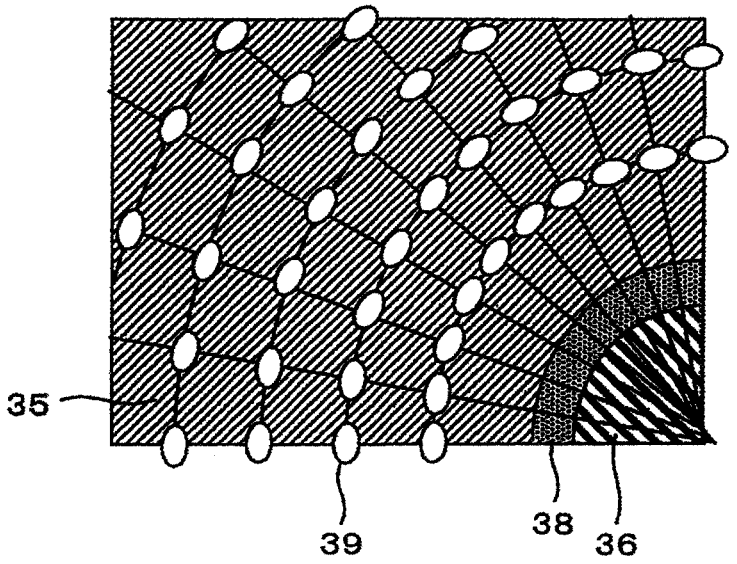
FIGS. 12A and 12B are schematic views showing cooling holes according to embodiment 3.
Figure 12B:
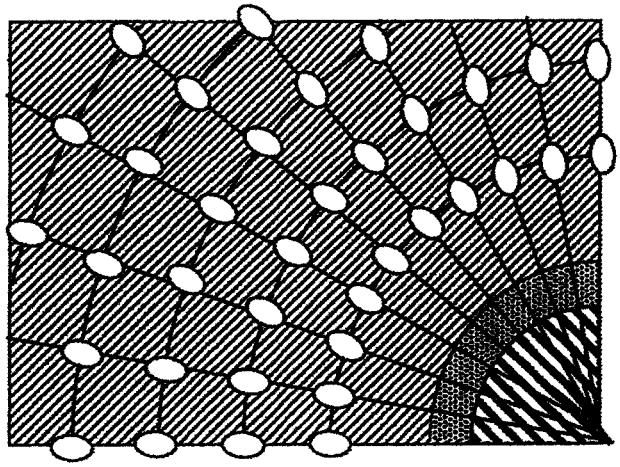

FIG. 11 shows one example of the shape and arrangement of the cooling holes 39. By forming the shape of the cooling hole 39 to be circular, stress concentration can be avoided. By making the sizes of the cooling holes 39 constant (uniform), variation of the cooling efficiency can be suppressed. Further, in order to cool the rotor disc efficiently and uniformly in the circumferential direction, the cooling holes 39 are arranged in a straight line in the radial direction.

In order to avoid stress concentration, the shape of the cooling hole 39 should not be a rectangle and a triangle with a sharp angle, but does not have to be necessarily circular. More specifically, the shape of the cooling hole 39 may be an ellipse. For example, the shape of the ellipse may be the one extending in the circumferential direction shown in FIG. 12A, or may be the one extending in the radial direction shown in FIG. 12B. By adopting such an elliptical shape, the opening area of the through-hole is increased more than in the circular shape, and the cooling efficiency of the rotor disc is enhanced.

Embodiment 4

Figure 13A:
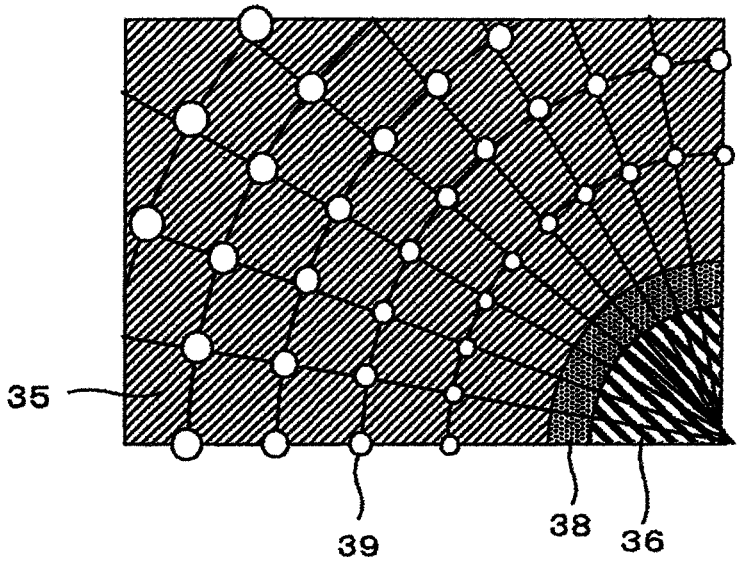
FIGS. 13A and 13B are schematic views showing cooling holes according to embodiment 4.
Figure 13B:
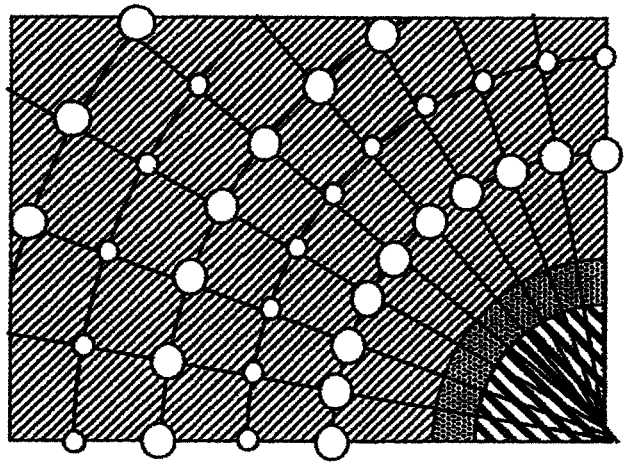

A fourth embodiment will be described by using FIGS. 13A and 13B. The present embodiment is an example of providing the cooling holes 39 by changing the size of the cooling holes 39. The other respects are the same as those in embodiments 2 and 3, and therefore, the description thereof will be omitted.

The size of the cooling hole 39 can be changed in accordance with the temperature distribution of the rotor disc. FIG. 13A is a view showing an example in which the sizes of the cooling holes are made gradually smaller in the radial direction. Further, FIG. 13B is an example in which the sizes of the cooling holes 39 vary periodically. By changing the arrangement and sizes of the through-holes, the distribution of the temperature in the rotor disc can be changed. By making the diameters of the cooling holes arranged on the inner circumferential side smaller than those of the cooling holes arranged on the outer circumferential side seen from the axis of the rotor shaft, the temperature can be reduced, in particular on the outer circumferential side where the temperature is high. By exercising ingenuity in size of the cooling hole 39 while considering the cooling efficiency, the cooling efficiency of the rotor disc can be enhanced more as compared with the case of uniform circles.

Embodiment 5

A fifth embodiment will be described by using FIG. 14. The present embodiment is an example in which the arrangement of the cooling holes 39 is changed. The other respects are the same as those in embodiments 2 to 4, and therefore, the description will be omitted.

Figure 14:
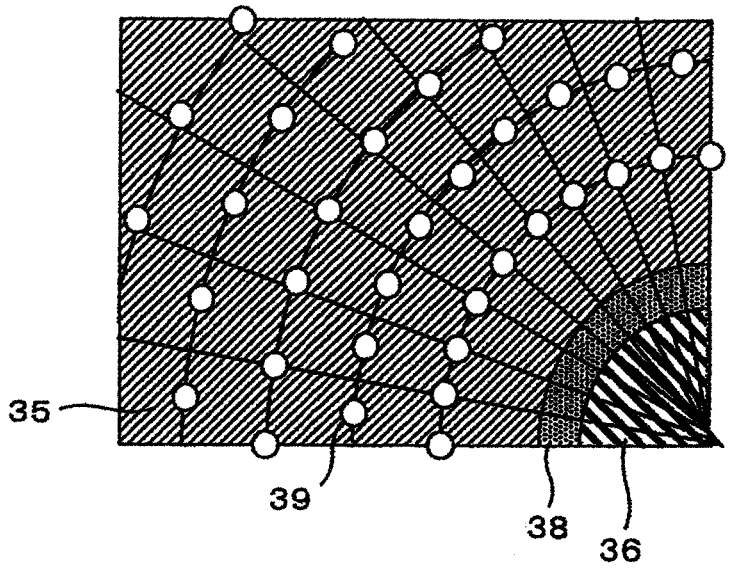
FIG. 14 is a schematic view showing cooling holes according to embodiment 5.

The example of FIG. 14 is an example in which the odd-numbered rows and the even-numbered rows are alternately shifted from the example of FIG. 11 in which the through-holes are provided in one straight line in the radial direction, with each distance between the through-holes being kept. The through-holes are provided periodically in one straight line in the radial direction. When the aggregate of the cooling holes 39 arranged on the inner circumferential side is defined as a first ring, and the aggregate of the cooling holes 39 arranged on the outer side thereof is defined as a second ring, the first and the third rings, and the second and the fourth rings are on different straight lines, for example, seen from the axial center. When the cooling holes are arranged on the circumference, the cooling holes on a predetermined circumference and the cooling holes on the other circumference are not arranged on one straight line extending in the radial direction, and therefore, the cooling efficiency of the rotor disc is increased more as compared with the example of FIG. 11.

Embodiment 6

Figure 15:
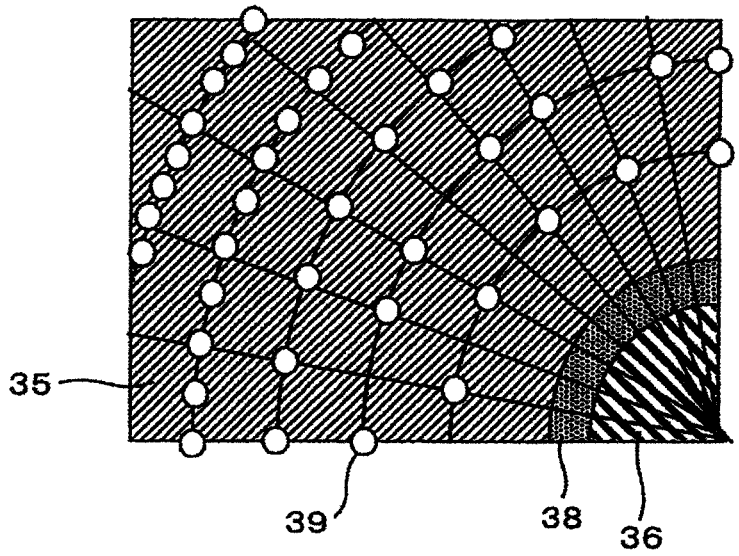
FIG. 15 is a schematic view showing cooling holes according to embodiment 6.

A sixth embodiment will be described by using FIG. 15. The present embodiment is an example in which the density of the cooling holes 39 is changed. The other respects are the same as those of embodiments 2 to 5, and therefore, the description will be omitted.

The densities of the cooling holes 39 on the outer side and the inner side with respect to an interior angle are the same in the example of FIG. 11. FIG. 15 is an example in which the number of through-holes is made large to increase the area on the outer side where the temperature is high, whereas the number of the through-holes is made smaller on the inner side where the temperature is low. In FIG. 15, the cooling holes are provided in the form of a plurality of circumferences, and the cooling holes in the outer circumferences are more densely disposed than those in the inner circumferences. The density of the cooling holes 39 is changed depending on the position on the rotor disc like this, and thereby, the cooling efficiency of the rotor disc is increased more.

Embodiment 7

A seventh embodiment will be described. In the present embodiment, an example in which the material of the rotor disc material is changed will be described. The other components are the same as those in embodiment 1, and the description will be omitted.

In embodiment 1, an Ni-base alloy material is adopted as the material of the outer rotor disc 35, and high chrome steel is adopted as the material of the inner rotor disc 36. As the tolerable temperatures of the materials, the tolerable temperature of Ni-base alloys is the highest, and the tolerable temperatures of high chrome steel and low alloy steel are lower in this sequence.

Further, in the actual machine, since each member is exposed to a high temperature, it is also necessary to consider thermal expansion, in addition to high-temperature strength. The thermal expansion coefficient of the Ni-base alloy material is the largest, and the thermal expansion coefficients of a low alloy steel material and a high chrome steel material are lower in this sequence. When a dissimilar weld material is used at a high temperature, it is preferable that the difference in thermal expansions is smaller. This is because a crack is likely to occur in the weld after welding or during operation due to the difference of the thermal expansions. For this reason, when an Ni-base alloy is adopted as the material of the outer rotor disc 35, it is desired that the low alloy steel is adopted as the material of the inner rotor disc.

By properly selecting the materials of the rotor discs like this, reliability of the weld is more enhanced.

Embodiment 8

An eighth embodiment will be described. In the present embodiment, an example in which the material of the rotor disc material is changed will be described. The other components are the same as those in embodiment 1, and the description will be omitted.

In embodiment 1, an Ni-base alloy material is adopted as the material of the outer rotor disc 35, and high chrome steel is adopted as the material of the inner rotor disc 36. However, when the steam temperature is low, the Ni-base alloy material does not always have to be adopted as the outer rotor disc 35. The tolerable temperature of the material of the Ni-base alloy is the highest, and the tolerable temperatures of high chrome steel and low alloy steel are lower in this sequence. Depending on the steam temperature, a high chrome steel material with a tolerable temperature lower than that of Ni-base alloys is desirably adopted.

The present embodiment is the example in which a high chrome steel material is applied to the outer rotor disc, and a low alloy steel material with a lower tolerable temperature is adopted for the inner rotor disc 36. The high chrome steel material is less expensive, and makes production of a large steel ingot easy. As a result, the rotor disc can be provided more easily.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A turbine rotor comprising:

a rotor shaft; and a rotor disc having a structure for fastening a turbine blade thereon;

wherein the rotor disc is composed by at least two members of an outer rotor disc and an inner rotor disc, and the inner rotor disc and the outer rotor disc are integrated by welding via a weld metal part;

wherein the outer rotor disc has cooling holes which penetrate the outer rotor disc in an axial direction of the rotor shaft; and wherein the cooling holes are arranged in a circumferential form, and the cooling holes arranged on an inner circumferential side have a diameter smaller than that of the cooling holes arranged on an outer circumferential side seen from an axis of the rotor shaft.

2. The turbine rotor according to claim 1, wherein the outer rotor disc is made from an Ni-base alloy, and the inner rotor disc is made from a high chrome steel material or a low alloy steel material.

3. The turbine rotor according to claim 1, wherein the outer rotor disc is made from an Ni-base alloy, and the inner rotor disc is made from a 12Cr steel material or a CrMoV steel material.

4. The turbine rotor according to claim 1, wherein the outer rotor disc is made from a high chrome steel material, and the inner rotor disc is made from a low alloy steel material.

5. The turbine rotor according to claim 1, wherein a sectional shape of a cooling hole is a circle or an ellipse.

6. A steam turbine comprising the turbine rotor according to claim 1.

7. A turbine rotor comprising:

a rotor shaft; and a rotor disc having a structure for fastening a turbine blade thereon;

wherein the rotor disc is composed by at least two members of an outer rotor disc and an inner rotor disc, and the inner rotor disc and the outer rotor disc are integrated by welding via a weld metal part;

wherein the outer rotor disc has cooling holes which penetrate the outer rotor disc in an axial direction of the rotor shaft; and wherein the cooling holes are arranged in a plurality of circumferential forms, and the cooling hole in a predetermined first circumference and the cooling hole in a second circumference adjacent to the first circumference on an inner or outer side thereof are not aligned in a straight line extending in a radial direction.

8. The turbine rotor according to claim 7, wherein the outer rotor disc is made from an Ni-base alloy, and the inner rotor disc is made from a high chrome steel material or a low alloy steel material.

9. The turbine rotor according to claim 7, wherein the outer rotor disc is made from an Ni-base alloy, and the inner rotor disc is made from a 12Cr steel material or a CrMoV steel material.

10. The turbine rotor according to claim 7, wherein the outer rotor disc is made from a high chrome steel material, and the inner rotor disc is made from a low alloy steel material.

11. The turbine rotor according to claim 7, wherein a sectional shape of a cooling hole is a circle or an ellipse.

12. A steam turbine comprising the turbine rotor according to claim 7.

13. A turbine rotor comprising:

a rotor shaft; and a rotor disc having a structure for fastening a turbine blade thereon;

wherein the rotor disc is composed by at least two members of an outer rotor disc and an inner rotor disc, and the inner rotor disc and the outer rotor disc are integrated by welding via a weld metal part;

wherein the outer rotor disc has cooling holes which penetrate the outer rotor disc in an axial direction of the rotor shaft; and wherein the cooling holes are arranged in a plurality of circumferential forms, and the cooling holes in a predetermined first circumference are arranged more densely than those in a second circumference provided inside the first circumference.

14. The turbine rotor according to claim 13, wherein the outer rotor disc is made from an Ni-base alloy, and the inner rotor disc is made from a high chrome steel material or a low alloy steel material.

15. The turbine rotor according to claim 13, wherein the outer rotor disc is made from an Ni-base alloy, and the inner rotor disc is made from a 12Cr steel material or a CrMoV steel material.

16. The turbine rotor according to claim 13, wherein the outer rotor disc is made from a high chrome steel material, and the inner rotor disc is made from a low alloy steel material.

17. The turbine rotor according to claim 13, wherein a sectional shape of a cooling hole is a circle or an ellipse.

18. A steam turbine comprising the turbine rotor according to claim 13.

* * * * *